US009877560B2

(12) United States Patent
Fulgham

(10) Patent No.: US 9,877,560 B2
(45) Date of Patent: Jan. 30, 2018

(54) WEIGHTED HAIR DEVICES AND METHODS FOR ELONGATING CURLY, COILY AND KINKY HAIR

(71) Applicant: Cynthia Fulgham, Daytona Beach, FL (US)

(72) Inventor: Cynthia Fulgham, Daytona Beach, FL (US)

( * ) Notice: Subject to any disclaimer, the term of this patent is extended or adjusted under 35 U.S.C. 154(b) by 0 days.

(21) Appl. No.: 15/416,788

(22) Filed: Jan. 26, 2017

(65) Prior Publication Data

US 2017/0143092 A1 May 25, 2017

Related U.S. Application Data

(63) Continuation-in-part of application No. 14/880,184, filed on Oct. 9, 2015, now abandoned, which is a continuation-in-part of application No. 13/709,747, filed on Dec. 10, 2012, now abandoned.

(51) Int. Cl.
*A45D 8/00* (2006.01)
*A45D 8/34* (2006.01)

(52) U.S. Cl.
CPC ..... *A45D 8/34* (2013.01)

(58) Field of Classification Search
CPC ..... A45D 2002/003; A45D 2002/008; A45D 2002/006; A45D 2002/007; A45D 2/02; A45D 2/08; A45D 2/10; A45D 2/127; A45D 2/14; A45D 2/18; A45D 2/025; A45D 2/04; A45D 2/122; A45D 2/001; A45D 2/146; A45D 2/148; A45D 2/2492; A45D 8/34; A45D 8/00; A45D 8/38; A45D 8/36; A45D 7/00; A45D 6/08; A61F 2002/448; A61F 2/446
USPC ..... 132/273, 274, 55, 270, 250, 246, 132/248.261; 623/17.16
See application file for complete search history.

(56) References Cited

U.S. PATENT DOCUMENTS 672,159 A * 4/1901 Bechtold ..... A45D 8/12 132/144
7,963,289 B1 * 6/2011 King ..... A45D 8/34 132/106
2005/0284493 A1 * 12/2005 Allen ..... A45D 2/2407 132/225
2010/0252062 A1 * 10/2010 Gregorek ..... A45D 2/122 132/200

* cited by examiner

*Primary Examiner* — Todd E Manahan
*Assistant Examiner* — Brianne Kalach
(74) *Attorney, Agent, or Firm* — Lori J. Sandman, Esq.

(57) ABSTRACT

Hair devices and methods which elongate curly hair by use of gravitational force, as the mass of the device weighs more than the hair section in order to transform curly hair into a wavy or straight coiffure. The device can be used as either a styling tool or an ornamental hair accessory that remains in the hair. The invented device is particularly advantageous for tightly coiled hair patterns of hair.

The device can include a first and second curved metal form, each having a plurality of ventilation cut-outs and tab ends which allow each of the forms to attach to one another in an oval configuration, which can be wrapped about a hair bundle, or in which a hair bundle can be inserted therein. Concave curved recesses in the plates can allow for another pair of curved plates that forms a second oval shape to be attached to each other by pin type members.

10 Claims, 4 Drawing Sheets

WEIGHTED HAIR DEVICES AND METHODS FOR ELONGATING CURLY, COILY AND KINKY HAIR

CROSS REFERENCE TO RELATED APPLICATIONS

This patent application is a Continuation-In-Part of U.S. patent application Ser. No. 14/880,184 filed Oct. 9, 2015, which is a Continuation-In-Part of U.S. patent application Ser. No. 13/709,747 filed Dec. 10, 2012, now abandoned. The entire disclosure of each of the applications listed in this paragraph are incorporated herein by specific reference thereto.

FIELD OF INVENTION

The invention herein relates to hair devices, and more specifically weighted hair devices that can include two or more curved metal plates with ventilation cut-outs which can attach to one another to form oval shaped devices, in which its mass weighs more than the weight of the hair section attached to the device. The invented device is used to exert a force on a bundle of hair by use of gravity for the purpose of naturally transforming the hair pattern of curly, coily and kinky hair into a wavy or straight coiffure.

BACKGROUND AND PRIOR ART

Currently, there is no prior art pertaining to weighted hair devices, tools or accessories or classification for weighted hair devices.

Currently, there is no prior art pertaining to hair devices, tools or accessories that elongates the natural texture of curly hair into a modified version of the user's natural curl pattern by use of its weight and gravity. Prior art for transforming curly hair either straightens the hair or changes the texture into a predetermined, unnatural curl or wave pattern, either temporarily by use of heat, with or without a secondary apparatus, or permanently by use of chemical processes. These methods can cause permanent damage to the hair, can be costly and time consuming, generally requires a professional hairstylist to execute properly and a strict maintenance routine to uphold the style.

Currently, there is no invented method in prior art that uses of the weight of a device, tool or accessory and/or by gravity to stretch and transform the natural texture of curly hair into a modified version of the user's natural curl pattern.

Also, there is no prior art pertaining to hair devices, tools or accessories that aid in drying curly hair, especially Afro hair, by temporarily elongating the curl structure by using weight and gravity to allow water to naturally flow away from the scalp and hair or by allowing the air from hairdryers to be concentrated and circulated nearest the scalp and away from the ends of the hair, while also containing the hair, preventing frizz and optimizing curl definition.

Prior art for aiding in drying curly hair is commonly by use of a diffuser, which is typically an attachment tool used with hand-held hairdryers. Generally, diffusers divert the concentrated, high velocity airflow produced from hairdryers, into a dispersed, gentle velocity, allowing curly hair to be dried with less disturbance of the curl pattern, which minimizes frizz and optimizes curl definition. However, diffusers are not well suited for tightly curled hair patterns, especially Afro hair. This hair type is typically too dense for the airflow from this tool to reach areas nearest the scalp without requiring extra manipulation and tends to concentrate the air and the heat on the ends of the hair, causing frizz and the disruption of curl definition, negating the usefulness of the tool. Also, due to the nature of tighter curls, the recommended technique of scrunching the hair while using a diffuser in order to encourage curl formation negates the usefulness of this tool for this hair type, as this technique would encourage knotting and tangling and frizz.

Additionally, there is no prior art pertaining to hair devices, tools or accessories, that aid in the care, maintenance and styling of natural Afro hair by temporarily elongating the hair's curl pattern by using weight and gravity, nor any prior art pertaining to devices, tools or accessories that provides fluidity and movement to natural Afro hair by using weight and gravity.

Thus, the need exists for solutions to the above problems with the prior art.

SUMMARY OF THE INVENTION

A primary benefit of the invented device is that it stretches and elongates curly hair textures naturally. The resulting coiffure is temporarily elongated curls reformed into a unique wave pattern relative to the size and shape of the user's natural curl pattern, without imposing an artificial curl or wave pattern as prior art provides. This is especially beneficial for tighter curl patterns, particularly coily and kinky hair, as the elongation achieved with the invented device will enable hair styling options that cannot otherwise be accomplished in its natural curly state. The invented device creates a variety of elongated patterns and styling options depending on the amount of hair attached to the device, amount of weight of the device attached to the hair, and the size of the device used and placement of the device (or devices) relative to the distance from the scalp.

The invention herein relates to an invented method of transforming curly hair into a wavy or straight coiffure by use of gravity. This method is natural and will not damage the hair. The elongated pattern created by the invented device is easily reversed by removing the device and exposing the hair to humidity or water.

The invention herein is a hair device, whereby the mass of the device weighs more than the section of hair to which it is attached in order to elongate the curl structure of curly, coily, and kinky hair by at least approximately 30%. The weight of the device naturally elongates the curl structure by use of gravity which can then be dried and set into a wave pattern. The invention herein is an invented method of transforming curly hair by use of gravity.

The invention herein is also an ornamental hair accessory which provides sustained elongation, and also provides fluidity and movement to Afro textured hair. The invented device can be secured to sections of hair in virtually any position without the need for auxiliary or moving parts by use of friction created by the curly hair section and design of the interior of the device.

An advantage of the invention is that currently there is no device or invented method of transforming curly hair by use of gravity in prior art that provides these benefits. Currently there is no classification for weighted hair devices, tools, or accessories.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
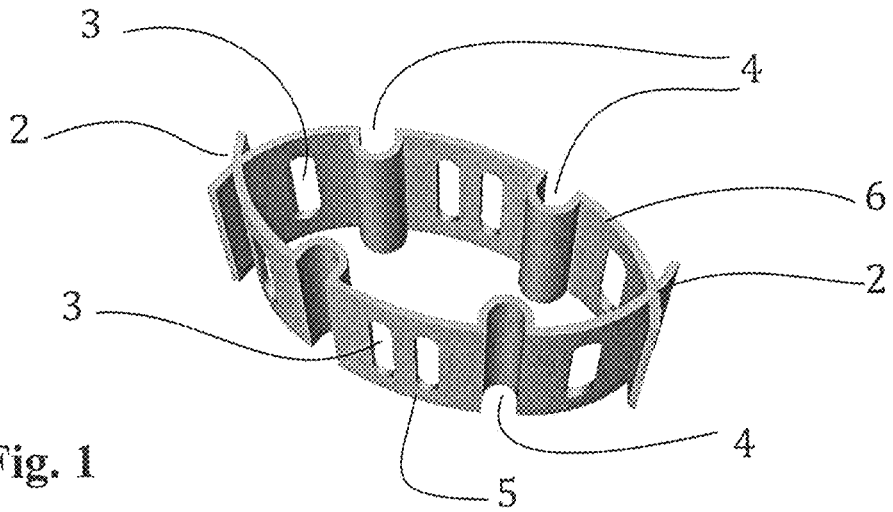
FIG. 1 shows a three-dimensional view depicting two plate metal forms, 5 and 6, with slotted cut-outs, 3, and concaved recessed columns, 4, connected by slotted tabs and friction, 2, which form a cylindrical shaped invented Weighted Hair Device.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Hair typing systems, such as Lois and Andre Walker, define each type with a numbering system '1' through '4', with '1' designated as straight hair and '4' as the curliest hair. These numbers are also assigned accompanying hair pattern designations 'a' through 'c' with 'a' indicating more texture than 'c'. Curly hair is defined as type 3a, 3b and 3c and coily and kinky hair textures as type 4a, 4b, and 4c. Type 4 textures are typically referred to as Afro hair, with type 4c having a very tight coil pattern.

Curly hair types have an elliptical cross-sectional shape and regions of twist reversal. The transition of the cuticle (the outermost structure) in the yield region (area of bend and/or twist) is the reason for the unique shape of the curves. The lack of symmetry of hair the follicle shape is responsible for hair curl.

A direct correlation between ellipticity and curl classification shows that, in general, hair that is more elliptical has a higher degree in curl. Also, thicker hair fibers tend to have a looser curl whereas thinner fibers are curlier. Afro hair is the most elliptical in cross section and on average is the least thick per strand but has an average of three strands per follicle. These characteristics explain why Afro hair typically has the curliest and most dense hair type and are most fragile to damage.

Healthy hair of all types have elasticity. Elasticity is the property of an object or material which causes it to be restored to its original shape after distortion. It is said to be more elastic if the material restores itself more precisely to its original configuration. The degree of elasticity determines hair's tensile strength and assesses the weight it can support. Generally elasticity and tensile strength depends on the health of the hair cortex, its inner most structure. However curly hair has more elasticity because of its spring or helix shape which is dictated by the cuticle, the outermost structure. Dense coily hair shows the highest elasticity and tensile strength whereas thin straight hair shows the least resistance to stretching and lowest tensile strength.

One of the properties of elasticity is that it takes about twice as much force to stretch a spring twice as far. That linear dependence of displacement upon a stretching force is called Hooke's law. Hooke's law is a principle of physics that states that the force (F) needed to extend (or compress) a spring by some distance (x) is proportional to that distance and the spring constant (k), which represents the degree of stiffness of the spring. The basic formula of Hooke's Law is written as $F=kx$, where F=weight X gravity. This law applies to any material or spring with elasticity and therefore can be used to determine how much force (or weight) must be applied to stretch a section of curly hair to any degree.

When curly hair gets wet, it can stretch approximately 30% of its dry state length. For example hair that's approximately 6" long will stretch approximately 1.8" wet. Using Hooke's Law it can be determined the force stretching wet hair is approximately 0.56 ounces. Hooke's Law also says this is the weight required to maintain a stretch of 1.8" after hair dries. And to gain 3.5" of stretch, a weight of approximately 1 ounce is required.

An approximately 6" long strand of hair has an average weight of approximately 0.83 milligrams. The average density of Type 4 hair is 900 hair follicles per square inch with 3 hairs per follicle. Using these calculations, it can be determined a bundle of Type 4 hair weighs approximately 0.16 ounces. Hair rollers, as referenced in prior art, are designed with lightweight materials in order to minimize stress on the hair to maintain its rolled position. A typical plastic hair roller weighs approximately 0.24 ounces. These devices are not of sufficient weight to apply a stretching force of any significance to transform curly hair.

The invented device is a useful styling tool for all curly hair types, especially Afro hair, that naturally elongates and stretches hair when used on wet hair prior to drying. When attached to a selection of wet hair, the weight of the invented device holds the hair in an elongated state. When the hair is dry and the invented device is removed, the hair is set into a unique wave pattern relative to the characteristics of the natural curl pattern.

The weight of the invented device can vary as curl types have varying degrees of curvature, as the curl ratio to length of hair, requiring more weight for tighter curl patterns. The size of the invented device or number of devices used will allow variations of weight applied to a hair section to accommodate different hair size sections, thicknesses and lengths, such as a pony tail Using the invented device to style natural curl patterns eliminates the need to use hairdryers, heated appliances, chemical perms and chemical straighteners, which can damage the hair.

The invented device is a useful styling tool for curly hair types that facilitates faster hair drying, which is especially beneficial for Afro hair. When air drying, the invented device holds the hair in an elongated state, allowing water to naturally flow away from the hair that would otherwise be restricted due to the natural density, shape and texture of the hair. When using a hairdryer, the invented device holds the hair in place and in an elongated state, allowing heated air to be concentrated and circulated nearest the scalp away from the ends of the hair and without blowing the hair around, which is paramount for inhibiting frizz and promoting optimal curl definition. When the invented device is positioned around the ends of the wet hair section, it retains moisture while the rest of the hair is dried, protecting the ends of the hair from heat and over-drying, which is most susceptible to damage and frizz.

The invented hair device is a useful styling tool that aids in the care and maintenance of Afro hair, especially long Afro hair. The invented device allows the hair to be easily cared for by creating manageable elongated sections and preventing the hair's natural tendency to recoil and tangle thereafter, which is especially problematic for Afro hair. The invented device provides this control during every phase of hair care maintenance from washing through drying and styling.

The invented hair device is also a useful hair accessory, especially for Afro hair, that keeps the hair in an elongated state indefinitely when the device is left in the hair, regardless of humidity or wetness.

The invented hair device is a useful hair accessory that provides fluidity and movement to Afro hair, which has little to no fluidity or movement in its natural state. The amount of hair attached to the invented device and placement of the invented device (or devices) relative to the end of the hair section will determine the extent of fluidity and movement attained. like a pendulum.

The invented hair device is a useful hair accessory that can be secured to sections of hair in virtually any position without any auxiliary or movable parts, that can be used on straight or curly hair, by use of friction.

The invention herein is a weighted hair device that is a tool and an ornamental hair accessory that has a mass that weighs at least 30% more than the bundle of curly hair to which it is attached and uses gravity as a method of elongating the structure of curly hair.

When used as a tool the weight of the invented device naturally stretches wet curly hair into a unique wave pattern relative to the user's natural curl pattern once the hair is dry and the invented device is removed. When used as a hair accessory the invented device keeps curly hair in an elongated state by virtue of the mass of the device and gravity which is especially beneficial for tightly coiled Afro textured hair. Currently there are no other inventions or prior art nor classification for weighted hair devices, tools, or accessories.

The invented device herein is generally uniformly constructed, and can include a solid metal plate form with or without cut-outs or openings, generally oval in shape and cross-section, however, can also be in the shape of a circle, square, rectangle, or polygon, with openings at each opposing end sufficiently sized to accept and contain a bundle of hair. The size and mass of the invented device can vary to accommodate small or large sections of hair like a pony tail. The invented device utilizes the body inherent in curly hair textures to hold the device in place by use of friction eliminating the need for any auxiliary means to hold the device in place.

The invented device herein is of rigid or semi rigid material, generally metal, that is noncorrosive or coated to prevent corrosion from common household cleaners, hair care products and water. Wireforming, shaping, molding, stamping and extruding are commonly known and frequently used manufacturing processes in metalworking capable of producing virtually any shape and form with various materials, in a plurality of gauges, widths and lengths. Painting, coating and plating of these materials are commonly used industrial processes which provides anti-corrosion and decorative properties to the selected material. These materials, either singularly or in combination, in the aforementioned configurations, are easily capable of being a mass far greater than a section of human hair of any length, which is required to be able to transform the curvature of curly hair by this invented method.

The drawings presented is an example of an oval shaped weighted hair device for a typical small bundle of hair that would have been selected for a hair roller as referenced in prior art.

A list of components will now be described.

1 assembled device
2. slotted tabs
3. slotted cut-outs
4. concave recessed columns
5, 6 curved forms
7. U shaped pins Referring to FIG. 1, a three-dimensional view of the invented device is depicted. In this example the invented device is comprised of two plate metal forms, 5 and 6, with at least four slotted cut-outs, 3, and four concaved, recessed columns, 4, which are connected together by use of slotted tabs and friction, 2. The slotted cut-outs provide ventilation to allow the hair within the invented device to dry and the concaved, recessed areas aid in securing the invented device to a bundle of hair.

Figure 2:
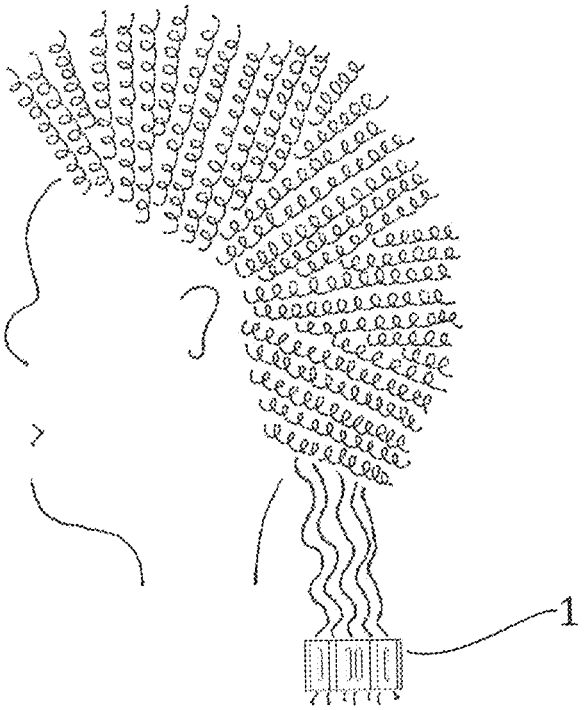
FIG. 2 shows a view of the invented Weighted Hair Device, as shown in FIG. 1, stretching a bundle of curly hair by method of gravity and the hair holds the invented device in place by use of friction.

Referring to FIG. 2, a bundle of curly hair stretched by the invented device, 1, is depicted. The invented device is held in place by use of friction with the aid of the four concaved, recessed columns, 4.

Figure 3:
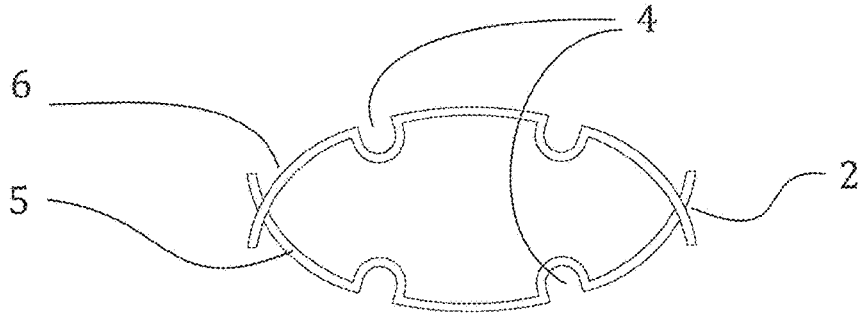
FIG. 3 is a top view of the plate metal forms of invented Weighted Hair Device, 5 and 6, showing the concaved recessed areas, 4, and connection of the metal forms by slotted tabs, 2, and friction.

Referring to FIG. 3, the top view of the invented device is depicted showing one front half, 5, and one rear half, 6, of the metal forms, the slotted tabs used to connect the two metal forms, 2, and the concaved recessed areas, 4.

Figure 4:
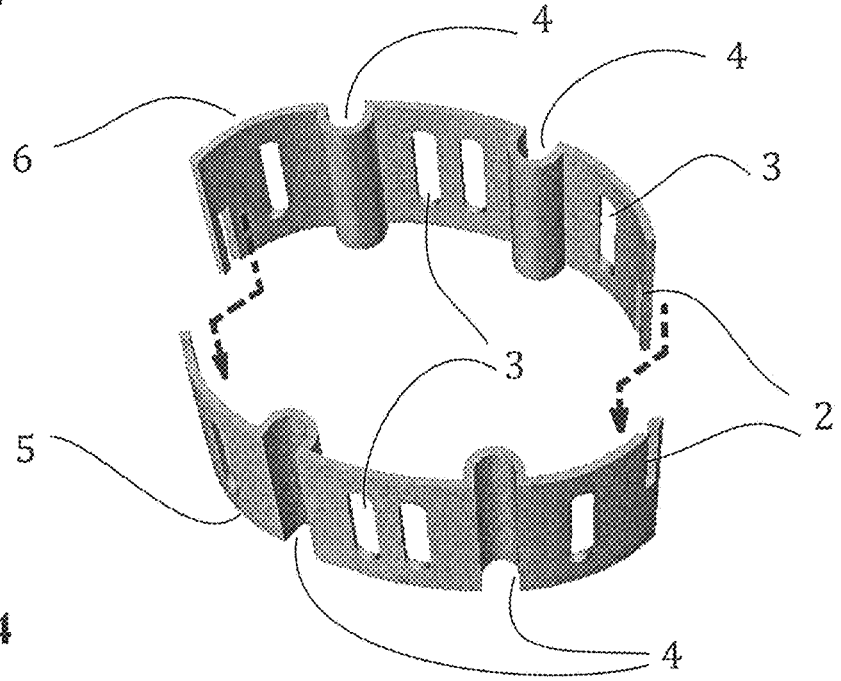
FIG. 4 is a front view, 5, and rear (interior) view, 6, of the plate metal forms of the invented Weighted Hair Device depicting the connection of the metal forms by slotted tabs and friction, 2.

Referring to FIG. 4, one front view, 5, and one rear or interior view, 6, of the metal forms of the invented device is depicted showing how the parts connect by the slotted tabs, 2. These tabs are sized so that when the metal forms are connected they are secured by friction.

Figure 5:
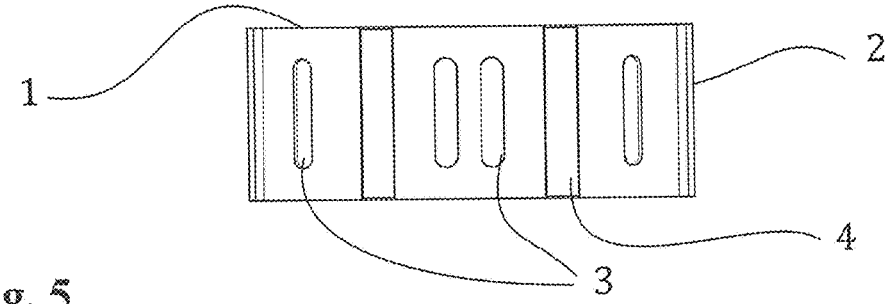
FIG. 5 is a front view of the invented Weighted Hair Device, 1, showing the invented device connected.

Referring to FIG. 5, a front view of the metal form of the invented device is depicted, 1, showing the parts connect by the slotted tabs, 2.

Figure 6:
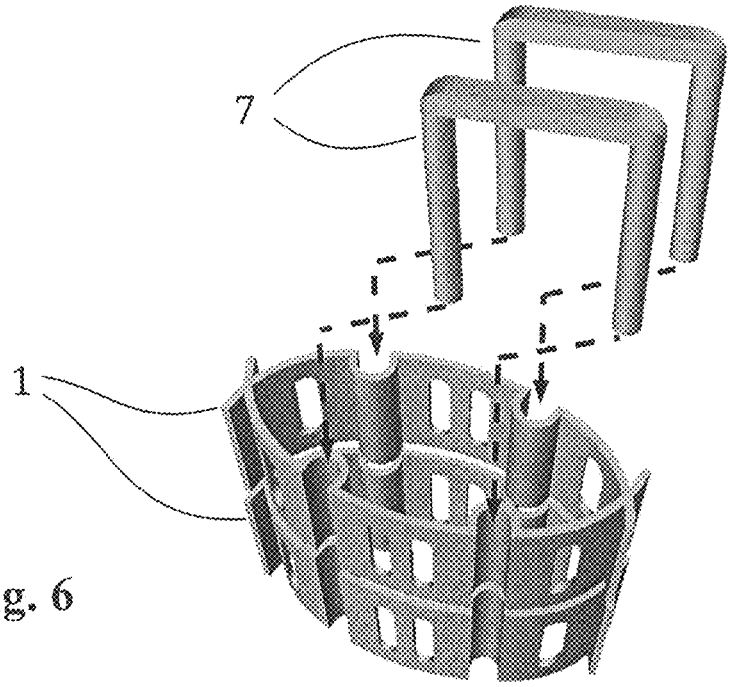
FIG. 6 is a three dimensional view of two invented Weighted Hair Devices, 1, depicting the connection by two U-shaped pins, 6, held in place by inserting the pins into the concaved recessed columns, 3, and friction.

Referring to FIG. 6, a three-dimensional view of two novel devices, 1, is depicted showing how the U-shaped pins, 7, secures the two invented devices together by inserting the pins into the concaved, recessed columns, 4. The use of two devices provides two times more weight as required to provide the equivalent amount of stretch for tightly, coiled hair types versus curly hair types.

Figure 7:
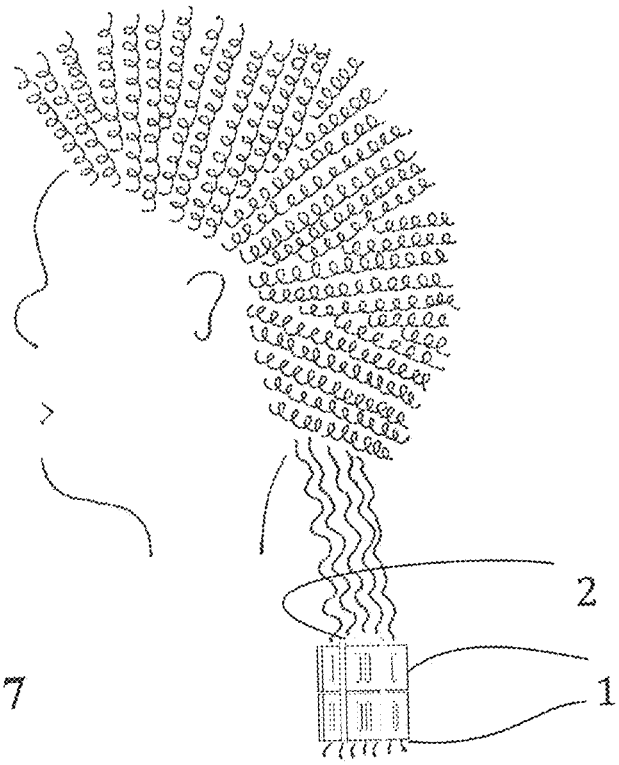
FIG. 7 shows a view of two invented Weighted Hair Devices, 1, connected by two U-shaped pins, 7, as shown in FIG. 6, stretching a bundle of tightly coiled hair which holds the invented devices in place by use of friction.

Referring to FIG. 7, a bundle of tightly coiled hair stretched by two invented devices, 1, is depicted. The invented devices are held together by U-shaped pins, 7, and is attached to the bundle of hair by use of friction.

Figure 8:
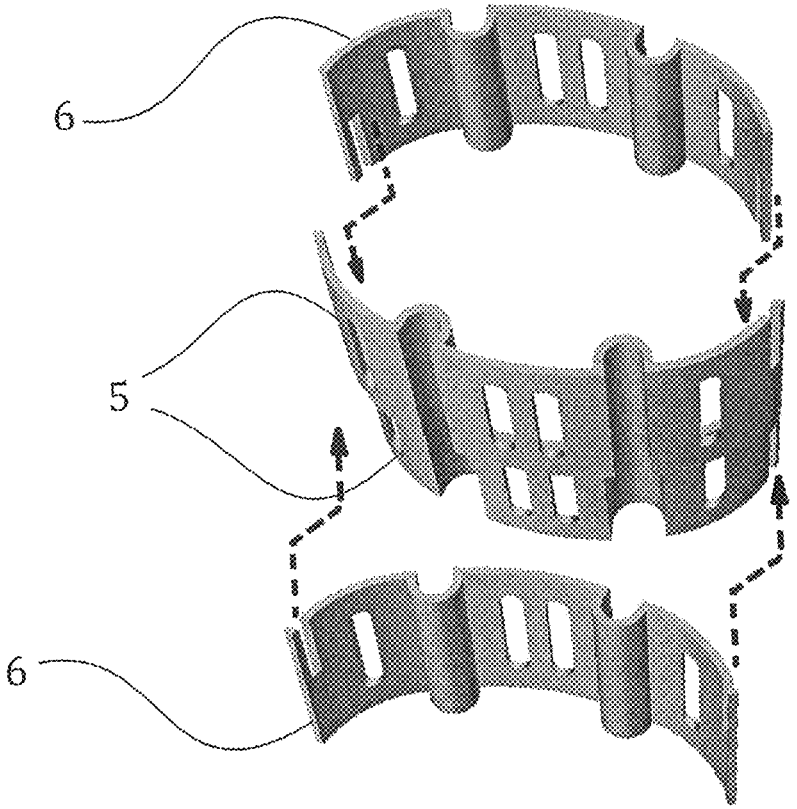
FIG. 8 is an exploded view of the metal forms forming the devices of the preceding figures about to be attached to one another.

FIG. 8 is an exploded view of the metal forms 6 forming the device 1 of the preceding figures about to be attached to one another.

The term "approximately" can be +/−10% of the amount referenced. Additionally, preferred amounts and ranges can include the amounts and ranges referenced without the prefix of being approximately.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A weighted hair device comprising:

a first curved metal plate form with a plurality of ventilation cut-outs and a plurality of concaved recesses, with the first form having slotted tab ends; and a second curved metal plate form with a plurality of ventilation cut-outs and a plurality of concaved recesses, with the second form having slotted tab ends, wherein the first curved plate form is connected to the second curved plate form by frictionally attaching the slotted tab ends of the first curved plate form to the slotted tab ends of the second curved plate form, whereby the connected plates form an oval shaped device with an opening sufficient to contain a bundle of hair having a length, and the weight of the device is adapted to apply a force on the bundle using gravity after having been inserted through the device and released, whereby the device is self-supported by friction caused by the bundle of hair after having been inserted through the device.

2. The weighted device of claim 1, wherein the plurality of the ventilation cut-outs in each of the first curved metal plate form and the second curved metal plate form include four ventilation cut-outs.

3. The weighted device of claim 1, wherein the plurality of the concaved recesses in the first curved metal plate form and the second curved metal plate form each include two concaved recesses.

4. The weighted device of claim 3, further comprising:

a third curved metal plate form with a plurality of ventilation cut-outs and a plurality of concaved recesses, with the third form having slotted tab ends; and a fourth curved metal plate form with a plurality of ventilation cut-outs and a plurality of concaved recesses, with the fourth form having slotted tab ends, wherein the third curved plate form is connected to the fourth curved plate form by frictionally attaching the slotted tab ends of the third curved plate form to the slotted tab ends of the fourth curved plate form, whereby the connected plates form a second oval shaped device; and members for attaching the first oval device to the second oval device, so that an oval shaped opening passes through both the first oval shaped device and the second oval shaped device.

5. The weighed device of claim 4, wherein the members are metal members.

6. The weighed device of claim 4, wherein the members are plastic members.

7. The weighted device of claim 4, wherein the members include:

pins inserted through adjacent concave recesses of the first oval shaped device and the second oval shaped device.

8. The weighted device of claim 5, wherein the pins include:

a first U-shaped pin having pin ends being inserted into a first adjacent pair of concave recesses of the first oval shape device and the second oval shape device; and a second U-shaped pin having pin ends being inserted into a second adjacent pair of concave recesses of the first oval shape device and the second oval shape device.

9. A weighted hair device comprising:

self-supported by friction caused by the bundle of hair after having been inserted a plurality of the oval shaped device of claim 1 connected by one or more pins inserted through adjacent concave recesses of the oval shaped devices, so that an oval shaped opening passes through and connects the plurality of the oval shaped devices.

10. The weighted device of claim 9, wherein the plurality of the ventilation cut-outs in each of the forms include four ventilation cut-outs.

* * * * *